US005695628A

United States Patent [19]

Chiavarotti et al.

[11] Patent Number: 5,695,628

[45] Date of Patent: Dec. 9, 1997

[54] METHOD OF USE OF AN ALUMINUM FOIL

[75] Inventors: Giovanni Pietro Chiavarotti, Milan; Francesco di Quarto, Palermo; Salvatore Piazza, Palermo; Carmelo Sunseri, Palermo, all of Italy

[73] Assignee: Becromal S.p.A., Quinto De' Stampi, Italy

[21] Appl. No.: 535,914

[22] Filed: Sep. 28, 1995

[30] Foreign Application Priority Data

Sep. 28, 1994 [DE] Germany ..... 44 34 557.7

[51] Int. Cl.[6] ..... G01N 27/26; G01J 1/42

[52] U.S. Cl. ..... 205/340; 205/335; 204/157.44; 204/400; 250/372

[58] Field of Search ..... 204/157.44, 400; 205/335, 340, 775; 250/372, 365

[56] References Cited

U.S. PATENT DOCUMENTS

| | | | |
|---|---|---|---|
| Re. 19,218 | 6/1934 | Ruben | 429/111 |
| 2,064,260 | 12/1936 | Herrmann | 204/157.44 |
| 3,628,017 | 12/1971 | Lerner | 250/83 |
| 4,107,008 | 8/1978 | Horvath | 204/129 |
| 4,481,091 | 11/1984 | Brus et al. | 204/157.1 |
| 4,948,685 | 8/1990 | Ohsawa et al. | 429/213 |
| 5,104,484 | 4/1992 | Nakanishi et al. | 156/651 |

FOREIGN PATENT DOCUMENTS

| | | |
|---|---|---|
| A-03 81 725 | 9/1923 | Germany . |
| 56-138221 | 10/1981 | Japan . |
| 1711062 | 2/1992 | U.S.S.R. . |

OTHER PUBLICATIONS

Spicer, W. E.; Selective Ultra-Violet Photoemitter, RCA Technical Notes No.: 520, Mar. 1962.

Vassiliev et al.; Electroreduction of Carbon Dioxide: Part I, J. Electroanal. Chem., 189(1985), 271–294.

CAS abstract of I. Kudarauskas, Radiats.–Stimul. Yavleniya Tverd. Telakh (1980), 2, 45–9.

Full article of I. Kudarauskas, Radiats.–Stimul. Yavleniya Tverd. Telakh (1980), 2, 45–9.

P. 155 of Electroplating Engineering Handbook, 4th ed., ed. Lawrence J. Durney, Chapman & Hall, 1996.

P. 18 of The Surface Treatment and Finishing of Aluminium and Its Alloys, 5th ed., vol. 1, by Wernick et al., Finishing Publications, Ltd., 1987.

Patent Abstracts of Japan, vol. 5, No. 56, p. 57, 728 Apr. 17, 1981 & JP-A-56 010219, Matsushita, Feb. 2, 1981.

Derwent and JAPIO abstracts of JP 56138221 (Akihiko et al.) Oct. 28, 1981.

CAS abstract of Boudin et al.; Electrochemical Reduction of Carbon Dioxide in Aqueous Media, Ann. Fac. Sci., Sect. Biol., Chim. Sci. Terre (Univ. Kinshasa) (1982), 4(1–2), 59–75, no month available.

Full English language translation of JP 56138221 (Akihiko et al.) obtained by PTO through Schreiber Translations, no month available 1996.

Complete article in Russian of I. Kudarauskas, Radiats.–Stimul. Yavleniya Tverd. Telakh (1980), 2, 45–9, no month available.

Derwent abstract of SU 1711062 (A. E. Verte), Feb. 7, 1992.

Full English language translation of Su 1711062 (A.E. Verte, 1992, no month available 1996.

Full article in French by Boudin et al.; Electrochemical Reduction of Carbon Dioxide in Aqueous Media, Ann. Fac. Sci., Sect. Biol., Chim. Sci. Terre (Univ. Kinshasa) (1982), 4(1–2), 59–75, no month available.

*Primary Examiner*—T. Tung
*Assistant Examiner*—Alex Noguerola
*Attorney, Agent, or Firm*—Wenderoth, Lind & Ponack

[57] ABSTRACT

The use of an aluminum foil is proposed for the chemical reduction of fluid and/or gas-like components, like $CO_2$, and/or as a detector for electromagnetic radiation, e.g., in the ultra-violet spectrum. In this process the aluminum foil is subjected to a surface treatment which increases the surface coarseness. The coarse aluminum foil is placed as a negative electrode in an electrolyte bath containing the fluid and/or gas-like components which are to be reduced, thereby causing the aluminum foil to have a potential voltage. The coarse aluminum foil containing a potential voltage in the electrolyte bath is subjected to a photo emission process, e.g., placed under electromagnetic radiation which must be established, and the photo electric current is measured.

19 Claims, No Drawings

METHOD OF USE OF AN ALUMINUM FOIL

BACKGROUND OF THE INVENTION

1. Field of the Invention

The invention involves the use of an aluminum foil for the chemical reduction of fluid and/or gas-like components such as $CO_2$ or $N_2$ in an electrolyte bath, and/or as a detector for electromagnetic radiation, e.g., in the ultra-violet spectrum, using the photo emission process (photo effect).

2. Brief Description of Relevant Art

Under the concept of photo effect is understood the dissolving away of electrons from the interior of a solid body through the surface to the surrounding medium, air or vacuum, by means of irradiation by electromagnetic radiation, like light, x-ray or gamma rays. In this so-called external photo effect, an isolated, suspended metal plate is loaded with electromagnetic radiation, for example, radiated in the ultra-violet spectrum, to an electrical potential, if care is thereby taken to suction of the loosened electrons by means of an electrical field. The number of photo electrons or the current strength of the photo current formed by the photo electrons is proportional-to the frequency of the absorbed light intensity due to the effect of the monochromatic electromagnetic radiation. The kinetic energy of the photo electrons released is dependent on the frequency of the incoming electromagnetic radiation and the so-called electron affinity of the radiated metal.

SUMMARY OF THE INVENTION

The invention proposes the use of an aluminum foil for the chemical reduction of fluid and/or gas-like components, like $CO_2$ or $N_2$, in an electrolyte bath, and/or as a detector for electromagnetic radiation, e.g., in the ultra-violet spectrum, using the photo emission process. This goal is basically attained, by subjecting the aluminum foil to a surface treatment which increases the surface coarseness, by placing the aluminum foil in an electrolyte bath containing the fluid and/or gas-like components which are to be reduced, thereby causing the aluminum foil to have a potential voltage, and by subjecting the coarse aluminum foil with a voltage potential in the electrolyte bath to a photo emission process, e.g., under electromagnetic radiation which must be established. Aluminum foil prepared in such a manner is suited in a special manner for the chemical reduction of fluid and/or gas-like components and/or as a detector for electromagnetic radiation, since it can surprisingly be seen that even with the impact of relatively long-wave electromagnetic radiation on the aluminum foil, a surprisingly high quantum yield can be attained. The quantum yield is defined as the relationship between the number of measured electrons to the number of incoming photons. Fluid components can be reduced without any other means, because of the emitted photo electrons with strongly reducing effects. There also exists the possibility of reducing the very stable gas-like substances, like $CO_2$ or $N_2$, by means of the photo electrons exiting the aluminum foil.

In the preferred manner of constructing the invention, the aluminum foil is coarsened in a mechanical process, like sand blasting, by electro-mechanical polishing and/or by electro-chemical etching. The quantum yield is affected in a positive way by these measures.

In another form of constructing the invention the surface of the aluminum foil is provided with a coarseness factor between 1.75 and 3.

It is advantageous to use an aluminum foil with a capacity between 0.5 and 2.0 μF. $cm^{-2}$ with +8 V mercurous sulphate electrode (MSE).

In another favorable further development of the invention the surface of an untreated aluminum foil is enlarged by a surface treatment, in particular by electro-chemical etching or similar process by a factor (i.e. surface enlargement factor (SEF)) between approximately 10 and approximately 40.

It was also seen to be advantageous to treat the surface of the aluminum foil with perchloric acid and/or ethanol in order to enlarge the surface.

As an alternative to, or in combination with, the surface treatment of the aluminum foil with perchloric acid and/or ethanol, the surface can be treated, especially for radiation, with aluminum particles with a particle size or an average diameter between 1 μm and approximately 45 μm.

It is advantageous to employ solutions as an electrolyte bath that exclude conjugate base of strong acid anions, like halogens for example.

According to another characteristic of the invention an advantageous electrolyte bath manifests a pH value between approximately 5 and approximately 10.

In the Context of this invention, gas-like components, especially $CO_2$ or $N_2$, which can also be reduced by means of the aluminum foil because of the photo effect, are also included in the concept of electrolyte bath.

The amount of the potential voltage which is placed on the aluminum foil is preferred at a value below 2 volts. The electron affinity which must be overcome by the photo electrons when exiting the aluminum foil can advantageously be decreased by this measure. As a result there is also the possibility of using long-wave electromagnetic radiation to loosen the photo electrons from the aluminum foil, whereby in this case any number of suitable electromagnetic radiation sources can be employed.

It has been seen to be especially advantageous to use electromagnetic radiation in the ultra-violet spectrum.

In a special application case, electromagnetic radiation with a wavelength, λ, of approximately 300 nm was used advantageously.

In a special construction method one can use a fluid electrolyte bath, a potential voltage of approximately 1.8 to 1.9 volts and an electromagnetic radiation with a wavelength, λ, of approximately 300 nm. Under these conditions a surprisingly high quantum yield (number emitted electrons/number of photons present) of approximately 2% to approximately 4% was obtained.

Because of the high quantum yield the aluminum foil is advantageously suited for use as a detector of electromagnetic radiation, whereby the aluminum foil is irradiated with electromagnetic radiation, especially ultra-violet radiation and the photo current is mechanically measured. Due to the exceptionally high quantum yield, an especially sensitive measuring instrument or a sensitive detector for electromagnetic radiation is available as a result.

Further goals, characteristics, advantages and possible uses of the invention are shown in the following description of constructed process models. In these processes, all characteristics comprise the actual object of the foregoing invention in itself or in any logical combination, independent of their combination in any claims or their revisions.

DETAILED DESCRIPTION OF PREFERRED EMBODIMENTS

To use aluminum foil for the chemical reduction of fluid and/or gas-like components or as a detector for electromagnetic radiation the aluminum foil is subjected to surface treatment for enlargement of the effective surface or the surface coarseness. Then the aluminum foil is placed in an electrolyte bath as a negative electrode and is loaded with a potential voltage. If the aluminum foil is placed in an electrolyte bath and exposed to an electromagnetic radiation, preferably with wavelengths in the ultra-violet spectrum, the emission of photo electrons from the aluminum foil directly into the electrolyte bath can be observed, so long as the aluminum foil was subjected to a suitable surface treatment, had a potential voltage placed thereon and was irradiated with electromagnetic radiation of a suitable wavelength. This phenomenon of the emission of photo electrons from the aluminum foil directly into the electrolyte bath manifests some commonalities with the photo effect when it can be verified on the boundary layer between the metal and the vacuum at the time of the appearance of the electromagnetic radiation on the metal surface. The photo-induced emission of electrons from the aluminum foil which is placed in an electrolyte bath definitely manifests the following differing aspects:

A electrical double layer forms on the boundary layer between the metal surface and the electrolyte solution on which the entire potential voltage loaded onto the aluminum foil drops. The result is that an additional variation affects the photo emission of the electrons from the aluminum layer into the electrolyte bath. In comparison to the photo effect on a metal/vacuum boundary layer, the energy threshold value for the photo emission of the electrons varies in accordance with the equation:

$$E_{th}(eV)=E_{th}(0)-eV,$$

whereby $E_{th}$ (0) is that energy threshold value (corresponding to the so-called electron affinity) for a potential voltage of 0 based on the electro-chemical scale, and the term, eV, is the potential voltage of the aluminum foil in the electrolyte bath based on the reference electrode. The energy threshold value, $E_{th}$ (eV), visibly varies as a dependency of the potential voltage which was loaded. The basic difference compared to the photo effect on a metal/vacuum boundary layer results from the fact that the emplaced potential voltage leads to a polarization of the metal/solution boundary layer and affects in a basically linear manner the function of the electron affinity ($W_{Me/Sol}$) of metal placed in a solution.

While the emission of a photo electron from the metal into the vacuum can be interpreted as a purely physical phenomenon without a chemical reaction at the conclusion of the emission of the electrons, that is different in the case of a metal/solution boundary layer. There the electrons emitted because of the photo effect move into the solution or the electrolyte bath and initiate a series of chemical reactions. As a final result there is a chemical reduction of the fluid or gas-like components which are contained in the electrolyte bath.

An estimation of the intensity of the photo current on the metal/solution boundary layer is relatively difficult. With no consideration made for surface enlargement effects which normally can be traced back to surface coarseness and/or the electrons produced on the surface can be traced back to plasma variations in the metal, model calculations can be made for quantum yields for various metal/electrolyte surface in the order of magnitude $10^{-5}$ to $10^{-4}$.

In the special case involving an aluminum/vacuum boundary layer, quantum yields of approximately 4% can be measured for energy from impacting electromagnetic radiation near to the plasma frequency (hγ=10 eV). On the other hand in the case of an aluminum/electrolyte boundary layer an emission limiting value near to Hγ=2 eV can be verified which can be traced back to a reduction of the metallic electron affinity because the potential voltage was placed thereon. The electron affinity for the boundary layer/aluminum/electrolyte is approximately hγ=4.15 eV. An additional reduction of the electron affinity at the boundary layer aluminum/electrolyte could not be measured, since severe hydrogen development was observed for potential voltages more negative than −1.95 volts (based on mercurous sulphate electrode (MSE)) in the electrolyte bath.

As can be seen in the table at the end of the following description, an increase of the photo current can be attained by an appropriate surface treatment of the metal. Thus it can be shown, that the aluminum foil can be coarsened by a mechanical process, like sand blasting, by electromagnetical polishing or by electro-chemical etching or by a combination of these methods. The electro-polishing of the surface of the aluminum foil using perchlor acid and/or ethanol has proved especially useful, whereby the surface of the aluminum foil is polished during a follow-up step with aluminum particles having a diameter between approximately 1 μm and approximately 45 μm. The surface of the aluminum foil manifests a coarseness equating to a coarseness factor between 1.75 and 3. These coarseness factors are determined by measuring the capacity of the aluminum foil at 9 volts (MSE). Using the surface treatment methods described above, the surface of the aluminum foil is increased by a factor (surface enlargement factor—SEF) between approximately 10 and approximately 40.

The electrolyte bath consists of such solutions as contain no conjugate base of strong acid anions, like for example halogens. The pH value of the electrolyte bath lies in a range between approximately 5 and approximately 10. Due to the hydrogen development in the electrolyte bath mentioned above, the amount of the potential voltage is set below approximately 2 volts. With respect to the incoming electromagnetic radiation, it is a matter of wavelengths in the ultra-violet spectrum; in particular radiation with a wavelength, λ, of approximately 300 nm is employed. That equated to a photo energy of hγ=4 eV. Under these conditions a quantum yield of between approximately 2% and approximately 4% can be attained continuously and also when the system is in a transient state.

If the severely reduced external effects of the emitted photo electrons are considered, a reduction of very stable gas-like substances, like $CO_2$ or $N_2$, can be achieved with this system. Another type of use of the system consists of the employment of the aluminum/solution boundary layer as a detector for electromagnetic radiation, especially in the ultra-violet spectrum, in which a high quantum yield can be achieved.

| Sample | Surface ($cm^{-2}$) | Capacity at +8 V (MSE) ($\mu F\ cm^{-2}$) | $I_{ph}$ (max) at −1.8 V (MSE) and λ = 300 nm (nA) | Coarseness factor | Surface enlargement factor (SEF) |
|---|---|---|---|---|---|
| Becromal 3D | 0.660 | 1.80 | 1050* | 3 | 27 |
| Electro-polished rod | 0.283 | 0.60 | 13 | 1 | 1 |
| Mechanically polished rod | 0.283 | 1.06 | 300 | 1.76 | 13 |

*$I_{ph}$ (max) = 1300 nA at −1.9 V(MSE)

What is claimed is:

1. A method of using an aluminum foil for chemical reduction of a fluid or gas component of an electrolyte bath or as a detector of electromagnetic radiation, which comprises:

placing an aluminum foil having a coarsened aluminum surface in an electrolyte bath, wherein said aluminum foil is prepared by a process which consists essentially of subjecting a starting aluminum foil to a surface treatment which removes aluminum surface material, to obtain said aluminum foil having the coarsened aluminum surface substantially without an oxide layer, loading said aluminum foil with a potential voltage to obtain a negative electrode, and subjecting said aluminum foil having the potential voltage in the electrolyte bath to an electromagnetic radiation, wherein electrons are emitted from the coarsened aluminum surface of said aluminum foil, such that the emitted electrons function to chemically reduce a fluid or gas component in the electrolyte bath, or such that the emitted electrons are measured to detect the electromagnetic radiation.

2. The method in accordance with claim 1, wherein the starting aluminum foil is coarsened mechanically.

3. The method in accordance with claim 1, wherein the starting aluminum foil is coarsened by electro-mechanical polishing or by electro-chemical etching.

4. The method in accordance with claim 1, wherein the surface of said aluminum foil has a coarseness factor of between 1.75 and 3.

5. The method in accordance with claim 1, wherein said aluminum foil has a capacity between 0.5 and 2.0 $\mu F. cm^{-2}$ at +8 V using a mercurous sulphate electrode.

6. The method in accordance with claim 1, wherein the surface of the starting aluminum foil is enlarged by the surface treatment by a surface enlargement factor of between about 10 and about 40.

7. The method in accordance with claim 6, wherein the surface treatment is electro-chemical etching.

8. The method in accordance with claim 1, wherein the surface of the starting aluminum foil is treated with perchloric acid or ethanol or both.

9. The method in accordance with claim 1, wherein aluminum particles having a particle size or having an average diameter between 1 μm and about 45 μm are used for polishing the surface of the starting aluminum foil.

10. The method in accordance with claim 1, wherein the electrolyte bath excludes anions of a conjugate base of a strong acid.

11. The method in accordance with claim 10, wherein the anions of the conjugate base of the strong acid are halogens.

12. The method in accordance with claim 1, wherein the electrolyte bath has a pH of between about 5 and about 10.

13. The method in accordance with claim 1, wherein the electrolyte bath has a gas component.

14. The method in accordance with claim 13, wherein the gas component is $CO_2$ or $N_2$.

15. The method in accordance with claim 1, wherein the potential voltage has a value lower than about 2 volts.

16. The method in accordance with claim 1, wherein the electromagnetic radiation is in the ultra-violet spectrum.

17. The method in accordance with claim 16, wherein the electromagnetic radiation has a wavelength, λ, of approximately 300 nm.

18. The method in accordance with claim 1, wherein the process has a quantum yield of about 2% to about 4% in the electrolyte bath, under conditions wherein the potential voltage is between about 1.8 to about 1.9 volts and the electromagnetic radiation has a wavelength, λ, of approximately 300 nm.

19. The method in accordance with claim 1, wherein said aluminum foil is bombarded with electromagnetic radiation in the ultra-violet spectrum, and the photocurrent of emitted electrons is measured to detect the electromagnetic radiation.

* * * * *